US005596866A

United States Patent [19]

Martin-Cocher et al.

[11] Patent Number: 5,596,866

[45] Date of Patent: Jan. 28, 1997

[54] METHOD AND DEVICE FOR THE EXTERIOR PACKAGING, BY HEAT-SHRINKING, OF A PALLETIZED LOAD

[75] Inventors: Jean-Paul Martin-Cocher, La Motte Servolex; Georges Jaconelli, Brison St-Innocent, both of France

[73] Assignee: Newtec International, Viroflay, France

[21] Appl. No.: 514,880

[22] Filed: Aug. 14, 1995

[30] Foreign Application Priority Data

Aug. 12, 1994 [FR] France ..... 94 09992

[51] Int. Cl.[6] ..... B65B 53/02

[52] U.S. Cl. ..... 53/442; 53/557

[58] Field of Search ..... 53/442, 459, 557, 53/567

[56] References Cited

FOREIGN PATENT DOCUMENTS 0266562 10/1987 European Pat. Off. .
0601222 12/1992 European Pat. Off. .
2339546 8/1977 France .
9001052 5/1990 Germany .

*Primary Examiner*—Linda Johnson
*Attorney, Agent, or Firm*—Schwartz & Weinrieb

[57] ABSTRACT

A method and a an apparatus for the exterior packaging of a palletized load supported by a platform (2) and by at least two lateral sliding supports (11, 12) contiguous with two longitudinal edges (7) of a lower face (3) of the deck (2) of the palletized load (1)is disclosed. The lower face (3) has two transverse sides (6) for taking up the load by means of a handling device. The method includes a preliminary step of covering the palletized load with a film (20) made of a heat-shrinkable material, followed by a step of heat-shrinking the material. According to the invention, the heat-shrinking step involves, on the one hand, shrinking a return portion (23) of the film beneath the lower faces (9) of the lateral sliding supports (11, 12) and conforming the film (20) along the transverse sides (6) in order to conform the lower edge of the film so as to be substantially level with the platform (2)with is a central region (26).

28 Claims, 5 Drawing Sheets

METHOD AND DEVICE FOR THE EXTERIOR PACKAGING, BY HEAT-SHRINKING, OF A PALLETIZED LOAD

The subject of the present invention is a method and a apparatus for the exterior packaging, by heat-shrinking, of a palletized lead, in which a cover made of heat-shrinkable material is stretched around the palletized lead during a heat-shrinking step.

BACKGROUND OF THE INVENTION

In the field of food products, the storage of palletized loads is very frequently carried out automatically at the end of the manufacturing places.

In the case of standard pallets, which constitute 90% of the pallets reused in recycle throughout the world, the cohesion between the load and the pallet is provided by a film secured beneath the lower deck of the pallet, and, while pallets are being manipulated, the forks of the handling equipment penetrate the entry slots of the pallet, perforating, or tearing, the plastic film, thus resulting in a weakening or destruction of the bond between the pallet and the palletized lead.

In addition, the storage of palletized loads in racks, in several rows and on several levels, is generally carried out by handling robots which are equipped with forks identical to those of fork-lift trucks. The automation of the insertion of the forks into the pallet requires the monitoring, by means of photoelectric cells, of the passage between the sliding supports or skis.

The presence of an exterior packaging film, generally made of polyethylene, around the palletized load disturbs this monitoring and it is desirable for the position of the exterior packaging film to be reproducible.

OBJECT OF THE INVENTION

The subject of the present invention is a method and apparatus making it possible, in the case of heat-shrinkable exterior packaging, for the region of insertion of the forks into the pallet to be clear of the exterior packaging film, and possibly:

- for the film to be clear with a tolerance of a few millimetres in the area delimited by the skis and the upper deck of the pallet;
- and/or for perfect fastening of the film under the external skis and over their entire settlement area, to be guaranteed;
- and/or for perfect protection from water splashes on the first tier of the palletized load to be guaranteed.

SUMMARY OF THE INVENTION

To this end, the invention relates to a method for the exterior packaging of a palletized load supported by a platform and by at least two longitudinal sliding supports contiguous with two longitudinal sides of a lower face of the deck of the palletized load, the lower face having two transverse sides for insertion of a handling device, the method including a preliminary step of covering the palletized load with a film of heat-shrinkable material, followed by a step of heat-shrinking of the material, characterized in that the heat-shrinking step involves, on the one hand, shrinking a return portion of the film beneath the lower face of the two longitudinal supports and, on the other hand, conforming the film along the transverse sides of the deck in order to bring back thereto the lower edge of the film so as to be substantially level with the lower face of the deck of the palletized load.

In the case where the base also includes at least one central sliding support arranged between the longitudinal sliding supports and parallel to them, and extending between the two transverse sides of the lower face of the platform, it is advantageous for the heat-shrinking step to include the following sub-steps:

(a) heat-shrinking, over its perimeter, the lower part of the film by folding back the return portion of the film return beneath the lower face of the longitudinal sliding supports, while at the same time moving the lower part of the film away from the central sliding support, at least during a phase in which the lower part of the film is capable of adhering to the central sliding support;

(b) after the lower part of the film has started to soften, pushing back the latter onto the two transverse sides, at least until the film is level with the lower face of the platform of the palletized load in order to achieve the desired conformation;

(c) heat-shrinking the rest of the film.

It should be pointed out that step (b) may start before completing step (a), that is, immediately after the start of the softening of the lower part of the film.

It is particularly advantageous for sub-step (c) to start only after completing both steps (a) and (b), so as to ensure that, while the rest of the film is shrinking, the lower part of the film has a mechanical strength sufficient to withstand the mechanical forces generated by this shrinking.

In the case of a palletized load which includes spacer boards arranged plumb with the transverse sides of the deck or platform and forming bridge regions between the lower faces of the longitudinal sliding supports and the central sliding support, it is advantageous, during sub-step (a), for the lower part of the film to be moved away from the spacer boards.

The method according to the invention advantageously includes a sub-step (b') of conforming edge portions of the lower part of the film which extend between the lower face of the longitudinal sliding supports and the transverse sides of the lower face of the platform of the palletized load. This makes it possible to complete the conformation of the film over its entire lower perimeter. Sub-step (b') is preferably carried out after completing step (b), that is, after completing the conformation of the film along the transverse sides.

It is particularly advantageous for the method to include a step of pinching the lower edges of the film along the transverse sides of the lower face of the palletized load, before heat-shrinking the film onto the longitudinal and transverse faces of the palletized load. This pinching of the film against the pallet makes it possible to avoid "skirting", that is, vertical shrinkage, thereby protecting the first tier.

According to a preferred embodiment, the step of heat-shrinking the material employs a heating frame which, in the first place, locally heat-shrinks the lower part of the film and then, by moving the heating frame, progressively heat-shrinks the rest of the film, at least onto the longitudinal and transverse faces of the palletized load.

The invention also relates to apparatus for the exterior packaging of a palletized load, for the implementation of the above method, characterized in that it includes:

- a device for depositing a heat-shrinkable film onto the load;
- a heating device for shrinking the film;

at least one pusher which can move vertically between a rest position, in which it is remote from the film, and an active position, in which it raises the lower edge of the film in order to conform it so as to be substantially level with the transverse sides of the lower face of the platform of the palletized load.

According to a preferred embodiment, the heating device includes a heating frame and the device includes a means for moving the heating device and the palletized load with respect to each other.

Advantageously, the device includes a reciprocating device which can move between a rest position, in which it is remote from the film, and an active position, in which it moves the lower part of the film away from a central region of the transverse sides of the base.

According to a first variant, the reciprocating device includes fingers which have a longitudinal axis, which is horizontal in the rest position, and which can be moved translationally and rotationally, the longitudinal axis becoming vertical in the active position.

According to a preferred embodiment, the reciprocating device includes fingers which can move in the active position by translation in a horizontal direction towards the outside and beyond the transverse sides of the lower face of the palletized load. Such a reciprocating device makes it possible, in particular, to handle the case of pallets in which spacer boards, arranged plumb with the transverse of the deck or platform, form bridge regions between the lower faces of the longitudinal sliding supports and the central sliding support.

The apparatus advantageously includes conforming fingers which can move between a rest position, in which they are remote from the film, and an active position, in which they conform edge portions of the lower part of the film, which extend between the lower face of the longitudinal sliding supports and the transverse sides of the lower face of the platform.

The apparatus may also include a apparatus for pinching the lower edges of the film along the transverse sides of the lower face of the palletized load, this apparatus being movable between a rest position, in which it is remote from the film, and an active position for pinching, the film so as to prevent vertical shrinking or "skirting" of the film during the operation of heat-shrinking the film onto the longitudinal and transverse faces of the palletized load.

BRIEF DESCRIPTION OF THE DRAWINGS

Other characteristics and advantages of the invention will become more apparent from the following description, given by way of non-limiting example, in conjunction with the drawings in which like reference characters designate like or corresponding parts throughout the several views, and wherein.

DETAILED DESCRIPTION OF THE ILLUSTRATED EMBODIMENTS

Figure 1:
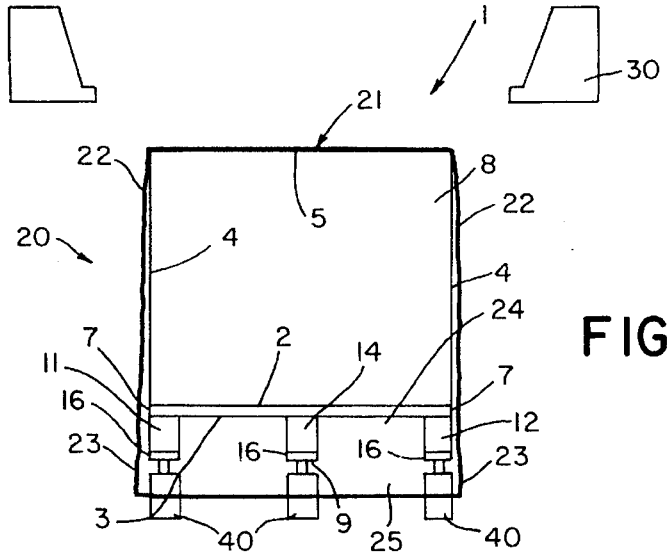
FIGS. 1, 2, 3*a*, 3*b*, 4*a*, 4*b*, 5*a*, 5*b*, 6*a* and 6*b* illustrate the steps of the method according to the invention, using apparatus according to the invention, for a palletized load shown in FIG. 7, and FIGS. 8*a*, 8*b* on the one hand and 9*a*, 9*b* on the other hand represent, respectively, variants of the steps shown in FIGS. 3*a* and 3*b* and of the steps shown in FIGS. 5*a* and 5*b*, in the case of a palletized load shown in FIG. 10.
Figure 7:
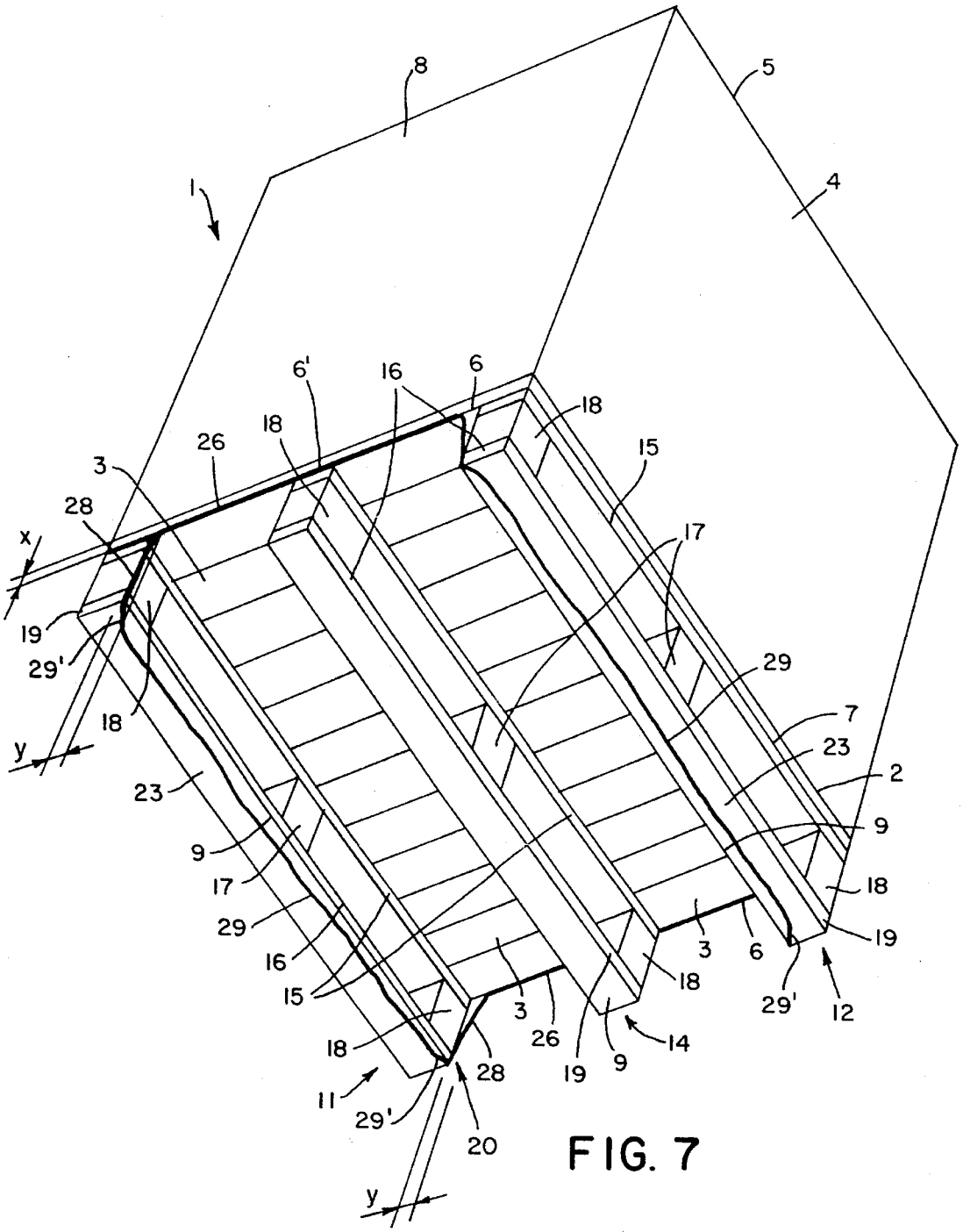

According to FIGS. 1 and 7, the palletized load designated by the general reference character 1 includes a load which is delimited by longitudinal faces 4 and transverse faces 8 and by an upper face 5 and which is settled on a pallet which comprises a platform 2 carrying the load and which has a lower face referenced 3. The lower face 3 has longitudinal edges 7 and lateral edges 6. The palletized load is supported by sliding supports or "skis" designated by the reference numbers 11 and 12 for the longitudinal supports which extend along the longitudinal edges 7 under the lower face 3 of the platform 2, and by the reference number 14 for the central support which is parallel to the longitudinal supports 11 and 12 and which extends from one transverse edge 6 to the other. Each of these supports 11, 12 and 14 includes an upper plank 15 fixed to the lower face 3 of the platform 2, spacers, referenced 18, which are contiguous with the lateral edges 6 of the lower face 3 and central spacers 17, as well as a lower plank 16 on the lower face 9 of which the palletized load slides.

FIG. 1 shows the preliminary step in which the palletized load has been film with a cover 20 which includes an upper part 21, longitudinal faces 22 filming the longitudinal faces 4, of the load and transverse faces 24 covering the transverse faces 8 of the load. The faces or sides 22 are extended in the lower part of the palletized load by extensions 23 which extend just below the lower faces 9 of the lower planks 16. Likewise, the transverse faces 24 are extended downwards at 25 beyond the lower faces 9 of the planks 16. The extensions 23 and 25 form an additional length of, for example, 150 millimetres before shrinking. FIG. 1 shows more particularly the palletized load after it has been conveyed, by a chain conveyor, to a position beneath a shrinking frame 30 where it is supported by supports 40.

Figure 2:
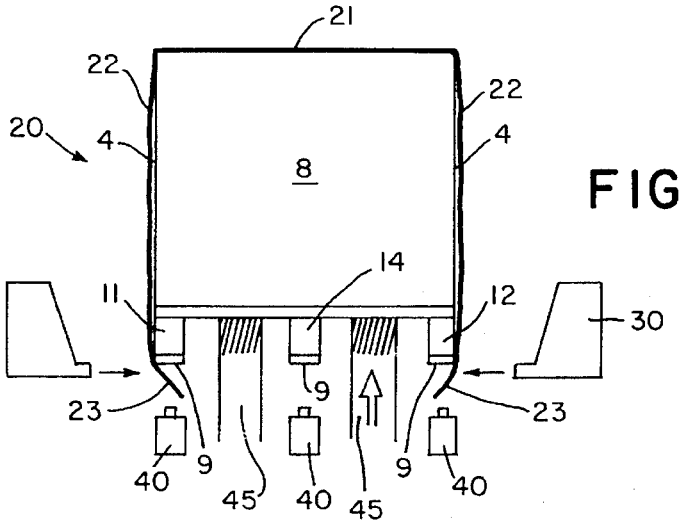

In FIG. 2, the load, which is centred beneath the shrinking frame 30, is raised by pushers 45 in order to allow the bottom part of the film, in particular extensions 23 and 25, to shrunk. For this shrinkage to take place, the frame 30 has been lowered to the vicinity of the lower faces 9 of the sliding supports 11 and 12. In FIG. 2, this shrinkage takes place by sending hot air outwardly from the perimeter of the frame towards the inside of the latter, this having the effect, in particular, of folding the extensions 23 beneath the supports 11 and 12. The frame 30 heats the extensions 23 and 25 and, possibly, a small part of the film located on the faces 4 and 8 in the immediate vicinity of the edges 6 and 7. While this shrinkage takes place, the extensions 23 resume the thickness that the film had on leaving the tube extruder, before it was expanded and wound up. The thickness of the film is thus multiplied by two or three, fold and the additional length of the extensions 23 changes, for example, from 150 millimetres to 80 millimetres. The extension 23 is flat and its edge 29 is thickened because of the aforementioned shrinkage, thereby giving it good mechanical strength.

During this operation, it is advantageous for a set of four fingers, referenced 50, to move the extension 25 of the film away from the vertical plane of the front and rear transverse faces 8 of the load, at least in the central region 6' of the transverse edges 6, so as to prevent the heat-shrinkable film from being in contact with the central support 14. This action of moving away the extensions 25 (shown in FIGS. 3*a* and 3*b*) firstly has the function of improving the behaviour of the load, preventing the film underneath the central support 14 from shrinking, and also of preparing, in an optimal manner, for the next step, shown in FIGS. 4*a* and 4*b*. During this step, pushers 60 having a flat upper region are moved vertically and raise that part of each extension 25 located between the outer supports 11 and 12 such that each extension 25 is, at least level with the lower face 3 of the deck 2 of the pallet.

Figure 3A:
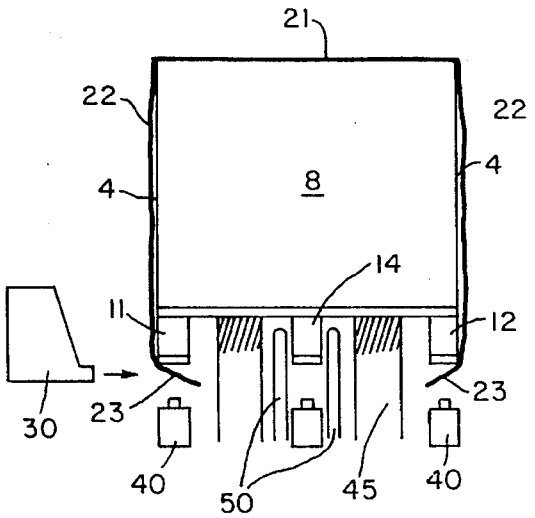
Figure 3B:
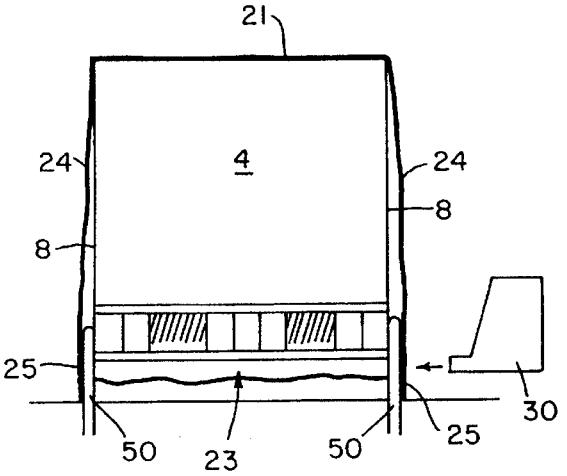

The order of the steps in FIGS. 3*a*, 3*b* on the one hand, and 4*a*, 4*b* on the other hand is preferably as follows:

Each extension 25 is moved away by the fingers 50 preferably when the film starts to soften and just before it shrinks. The reason for this is that as long as the film has not started to soften, there is no risk of it adhering to the central support 14 or of it shrinking beneath the central support 14, and it is therefore possible to wait until the film has started to soften before moving each extension 25 away, thereby making it possible to limit as far as possible the heating of the fingers 50 through the action of the heating caused by the frame 30. The fingers 50 are preferably made of metal, for example steel, filmed with a non-stick layer, for example PTFE, and they may be air-cooled or water-cooled.

Figure 4A:
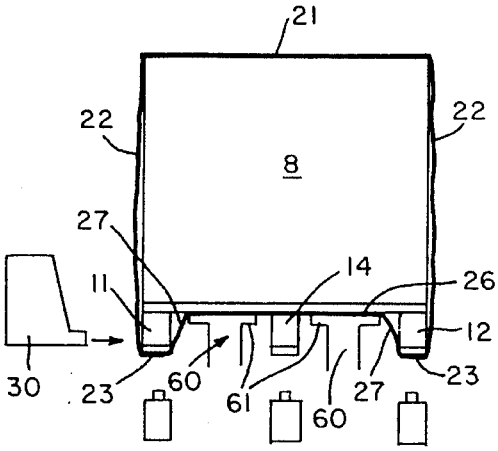
Figure 4B:
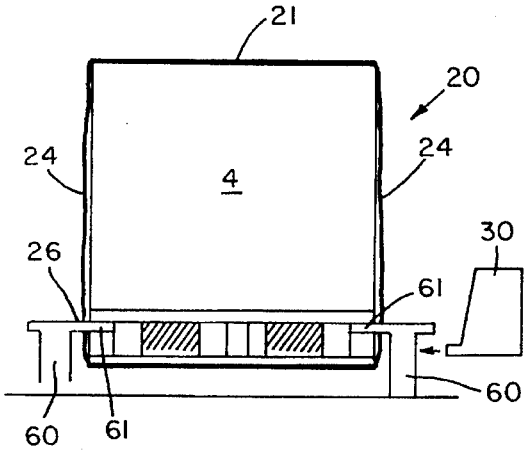

The step in FIGS. 4*a* and 4*b* is carried out when each extension 25 of the film has softened sufficiently so that, in the regions where it is raised by the pushers 60, it pleats, adhering to itself, forming a bead 26 heat-sealed onto itself. In FIGS. 4*a* and 4*b*, each extension 25 is raised only in the space lying between the central support 14 and the outer supports 11 and 12. In its central region, it rises, sliding along the ends of the support 14, while at its ends, it forms an inclined connection region 27.

Figure 5A:
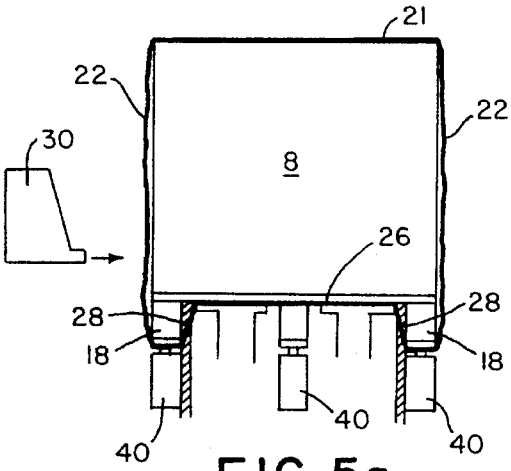
Figure 5B:
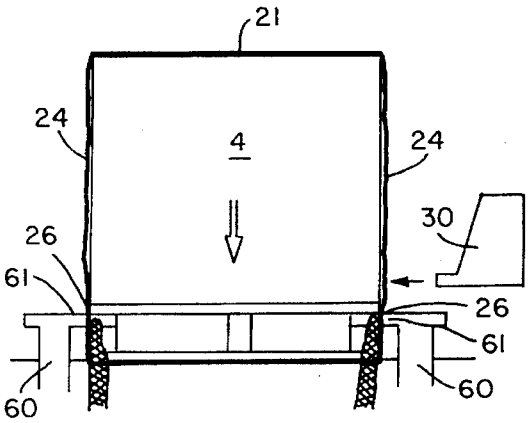

FIGS. 5*a* and 5*b* show the next step in which the aforementioned regions 27, which are still in a softening phase, are conformed into a bead 28 as close as possible to the spacers 18 of the supports 11 and 12 near the front and rear transverse faces 8 of the pallet, by means of which faces the handling forks are inserted longitudinally between the supports 11, 12 and 14 and parallel to them. The step in FIGS. 5*a* and 5*b* can be carried out after the palletized load has once again been settled on the supports 40 of the conveyor.

Figure 6A:
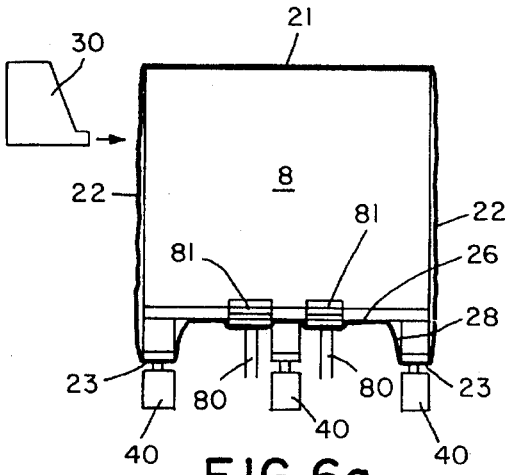
Figure 6B:
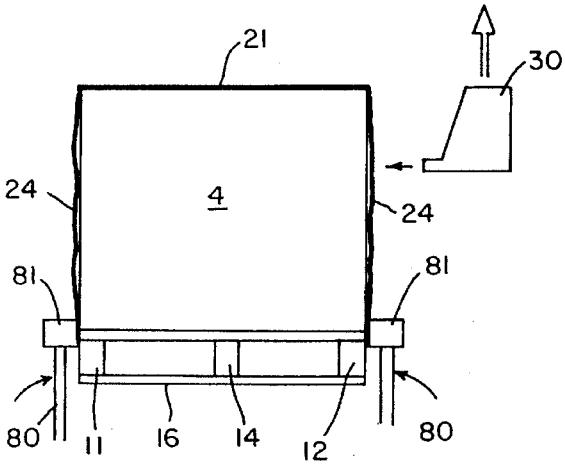

During the next step (FIGS. 6*a* and 6*b*), the frame 30 is moved upwards in order to shrink the longitudinal faces 22 and transverse faces 24 of the film 20. During this step, and according to the preferred embodiment shown, stops 81 are pressed against the platform 2 on either side of the central support 14 so as to pinch the film, and more particularly the bead 26, against the pallet in order to prevent vertical shrinkage or "skirting" of the bead 26 so as to allow protection of the first tier.

The exterior package as produced, which is shown in FIG. 7, makes it possible to guarantee a conformation of the film in which the "x" and "y" dimensions are within, for example, tolerances of plus or minus one centimetre. It should also be pointed out that an edge of having a thichness dimension which is greater than the thickness of the film delimits the latter, preferably over its entire contour (beads 26 and 28, thick edge 29) at the lower part of the pallet.

Figure 8A:
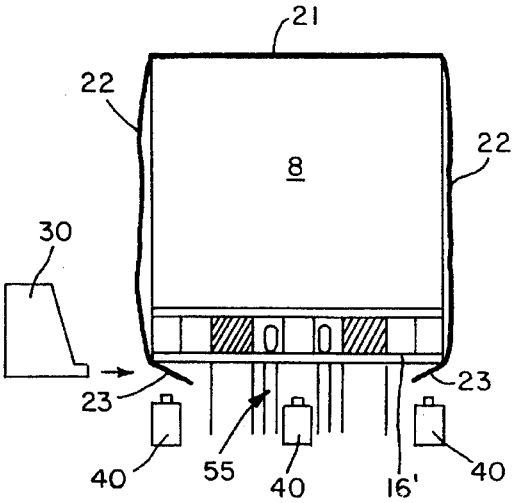
Figure 8B:
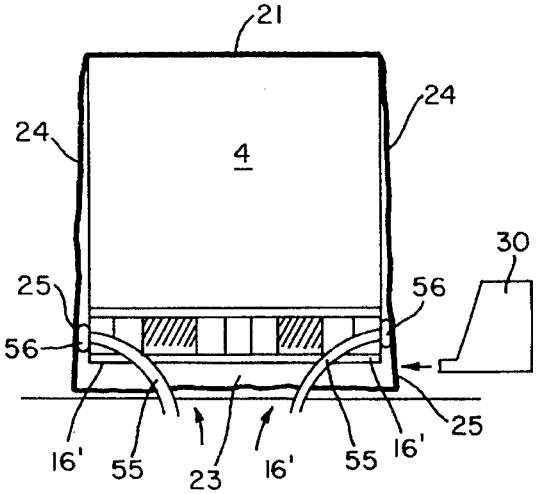
Figure 9A:
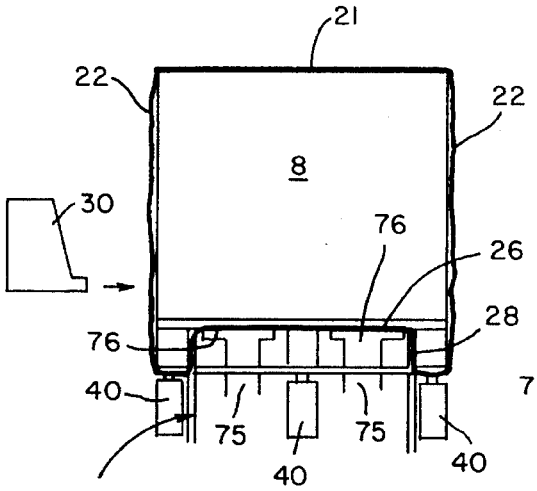
Figure 9B:
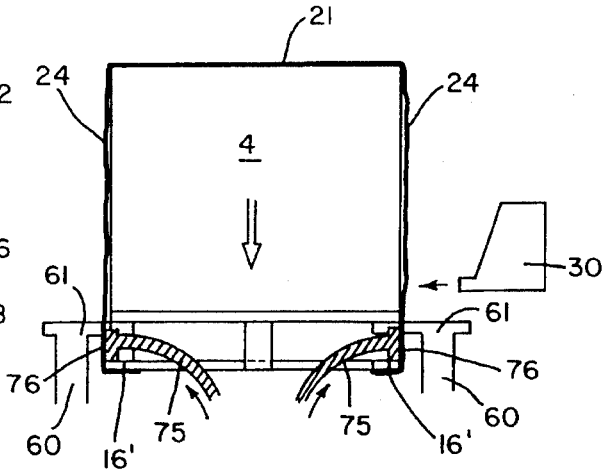
Figure 10:
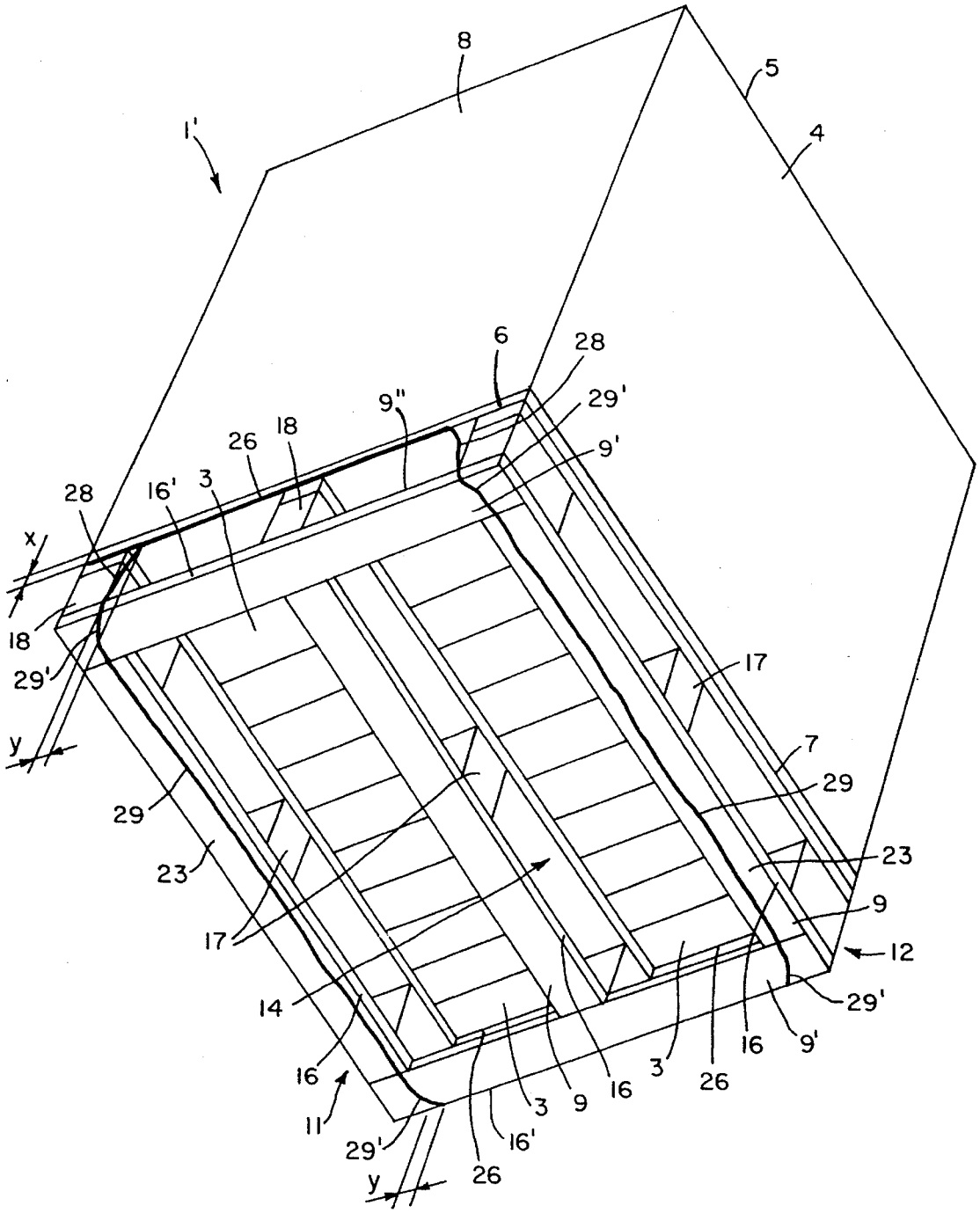

FIGS. 8*a* and 8*b*, and 9*a* and 9*b* show a variant of the steps illustrated respectively by FIGS. 3*a* and 3*b*, and 5*a* and 5*b*, with a view to making it possible to handle pallets such as shown in FIG. 10, which have transverse members 16' lying along the transverse edges 6 and forming bridges between the ends of the supports 11, 14 and 12.

In FIGS. 8*a* and 8*b*, each extension 25 is moved away from the load or pallet by means of an enlarged end 56 of curved fingers 55 which are inserted from underneath the pallet into the spaces lying between the upper faces 9" of the transverse members 16' and the lower face 3 of the platform 2. It should be pointed out that these curved fingers 55 could also be possibly used in the case of the palletized load in FIG. 7.

In the step shown in FIGS. 9*a* and 9*b*, curved fingers 75 having an enlarged end 76 form the beads 28, penetrating the spaces lying between the lower face 9" of the transverse members 16' and the lower face 3 of the platform 2.

By way of further description, the heat-shrinking step lasts approximately 20 seconds, that is approximately 5 to 10 seconds for shrinking and conforming the lower part of the film and 10 to 15 seconds for heat-shrinking the rest of the cover.

Obviously, many modifications and variations of the present invention are possible in light of the above teachings. It is therefore to be understood that within the scope of the appended claims, the present invention may be practiced otherwise than as specifically described herein.

We claim:

1. A method for the exterior packaging of a palletized load, supported upon a pallet comprising a platform and at least two longitudinal supports having two longitudinally extending sides disposed adjacent to two longitudinally extending sides of a lower surface of said pallet platform and two ends disposed adjacent to two transversely extending sides of said lower surface of said pallet platform so as to define therebetween, along said transversely extending sides of said pallet platform, at least one space for accommodating a pallet handling device, comprising the steps of:

covering said palletized load with a film made of heat-shrinkable material such that dependent lower end portions of said film extend below said longitudinal supports along both of said longitudinally extending sides of said pallet platform and along both of said transversely extending sides of said pallet platform;

heat shrinking portions of said film disposed along said longitudinally extending sides of said pallet platform such that said heat-shrunk portions of said film are disposed beneath said longitudinally extending sides of said longitudinal supports; and conforming portions of said film disposed along said transversely extending sides of said pallet platform to said transversely extending sides of said lower surface of said pallet platform by raising said dependent lower end portions of said film disposed along both of said transversely extending sides of said pallet platform across the entire width of said at least one space defined along both of said transversely extending sides of said pallet platform and between said at least two longitudinal supports disposed adjacent to said two longitudinally extending sides of said pallet platform such that said raised dependent lower end portions of said film are disposed at a level which is substantially coincident with said lower surface of said pallet platform so as to provide free entry, into said at least one space defined along each one of said transversely extending sides of said pallet platform, of a pallet handling device from a position external of said palletized load without any interference with said heat-shrinkable film disposed along said transversely extending sides of said pallet platform.

2. The method as set forth in claim 1, wherein said conforming step comprises:

raising said lower end portions of said film disposed along said transversely extending sides of said pallet platform until said lower end portions disposed along said transversely extending sides of said pallet platform form heat-sealed beads within the vicinity of said transversely extending sides of said lower surface of said pallet platform.

3. The method as set forth in claim 2, further comprising the step of:

further conforming side edge portions of said lower end portions of said film disposed along said transversely extending sides of said pallet platform to side edge portions of said longitudinal supports disposed interiorly of said pallet and facing said at least one space defined between said at least two longitudinal supports.

4. The method as set forth in claim 1, wherein:

said conforming of said portions of said film disposed along said transversely extending sides of said pallet platform comprises heat shrinking of said portions of said film disposed along said transversely extending sides of said pallet platform.

5. The method as set forth in claim 2, wherein:

said raising of said lower end portions of said film disposed along said transversely extending sides of said pallet platform comprises pushing said lower end portions of said film, disposed along said transversely extending sides of said pallet platform, upwardly into contact with said transversely extending sides of said lower surface of said pallet platform.

6. The method as set forth in claim 2, further comprising the steps of:

providing said pallet with a third longitudinal support interposed between and extending parallel to said at least two longitudinal supports;

moving said lower end portions of said film disposed along said transversely extending sides of said pallet platform away from said third longitudinal support of said pallet such that said lower end portions of said film disposed along said transversely extending sides of said pallet platform do not adhere to said third longitudinal support of said pallet prior to said raising of said lower end portions of said film disposed along said transversely extending sides of said pallet platform.

7. The method as set forth in claim 2, further comprising the step of:

heat-shrinking remaining portions of said film covering said palletized load and disposed along longitudinally extending sides of said palletized load as well as along transversely extending sides of said palletized load.

8. The method as set forth in claim 6, further comprising the step of:

providing said pallet with transversely extending support members which bridge together said at least two longitudinal supports and said third longitudinal support such that two spaces, into which said pallet handling device can be inserted, are defined between said lower surface of said pallet platform, said at least two longitudinal supports and said third longitudinal support, and said transversely extending support members.

9. The method as set forth in claim 7, further comprising the step of:

fixedly holding said raised portions of said film disposed in contact with said transversely extending sides of said lower surface of said pallet platform such that said raised portions of said film remain in contact with said transversely extending sides of said lower surface of said pallet platform while said remaining portions of said film covering said palletized load are heat-shrunk.

10. The method as set forth in claim 1, wherein:

said heat shrinking is accomplished by means of blown hot air.

11. Apparatus for the exterior packaging of a palletized load, supported upon a pallet comprising a platform and at least two longitudinal supports having two longitudinally extending sides disposed adjacent to two longitudinally extending sides of a lower surface of said pallet platform and two ends disposed adjacent to two transversely extending sides of said lower surface of said pallet platform so as to define therebetween, along said transversely extending sides of said pallet platform, at least one space for accommodating a pallet handling device, and wherein said palletized load is covered with a heat-shrinkable film such that dependent lower end portions of said film extend below said longitudinal supports along both of said longitudinally extending sides of said pallet platform and along both of said transversely extending sides of said pallet platform, comprising:

means for heat shrinking lower end portions of said film disposed along said longitudinally extending sides of said pallet platform such that said heat-shrunk portions of said film are disposed beneath said longitudinally extending sides of said longitudinal supports; and means for conforming lower end portions of said film disposed along said transversely extending sides of said pallet platform to said transversely extending sides of said lower surface of said pallet platform by raising said lower end portions of said film disposed along both of said transversely extending sides of said pallet platform across the entire width of said at least one pace defined along both of said transversely extending sides of said pallet platform and between said at least two longitudinal supports disposed adjacent to said two longitudinally extending sides of said pallet platform such that said raised lower end portions of said film are disposed at a level which is substantially coincident with said lower surface of said pallet platform so as to provide free entry, into said at least one space defined along each one of said transversely extending sides of said pallet platform, of a pallet handling device from a position external of said palletized load without any interference with said heat-shrinkable film disposed along said transversely extending sides of said pallet platform.

12. Apparatus as set forth in claim 11, wherein:

said heat shrinking means comprises means for blowing hot air toward said palletized load.

13. Apparatus as set forth in claim 11, wherein:

said heat shrinking means comprises a frame member for operatively acting upon peripheral regions of said palletized load.

14. Apparatus as set forth in claim 13, wherein:

said frame member is vertically movable between a first lowered position at which said frame member can heat-shrink said lower end portions of said film, and a second elevated position at which said frame member can heat-shrink upper portions of said film covering said palletized load and disposed along longitudinally extending sides of said palletized load as well as along transversely extending sides of said palletized load.

15. Apparatus as set forth in claim 11, wherein:

said means for conforming said lower end portions of said film disposed along said transversely extending sides of said pallet platform comprises means for raising said lower end portions of said film disposed along said transversely extending sides of said pallet platform until said lower end portions of said film disposed along said transversely extending sides of said pallet platform form heat-sealed beads within the vicinity of said transversely extending sides of said lower surface of said pallet platform.

16. Apparatus as set forth in claim 15, wherein:

said conforming means comprises vertically movable pusher members for engaging lower edge portions of said lower end portions of said film.

17. Apparatus as set forth in claim 11, further comprising:

means for moving said lower end portions of said film disposed along said transversely extending sides of said pallet platform away from said pallet, when said pallet comprises a third longitudinal support interposed between said at least two longitudinal supports, so as to prevent adherence of said lower end portions of said film disposed along said transversely extending sides of said pallet platform to said third longitudinal support of said pallet while said lower end portions of said film disposed along said transversely extending sides of said pallet platform are being conformed to said transversely extending sides of said lower surface of said pallet platform.

18. Apparatus as set forth in claim 11, further comprising:

means for conforming side edge portions of said lower end portions of said film disposed along said transversely extending sides of said pallet platform to side edge portions of said at least two longitudinal supports disposed interiorly of said pallet and facing said at least one space defined between said at least two longitudinal supports.

19. Apparatus as set forth in claim 14, further comprising:

means for fixedly holding said conformed portions of said film in contact with said transversely extending sides of said lower surface of said pallet platform while said frame member heat-shrinks said upper portions of said film covering said palletized load and disposed along said longitudinally and transversely extending sides of said palletized load.

20. In combination, a system for the exterior packaging of a palletized load, comprising:

a pallet comprising a platform and at least two, transversely spaced, longitudinal supports having two longitudinally extending sides disposed adjacent to two longitudinally extending sides of a lower surface of said pallet platform and two ends disposed adjacent to two transversely extending sides of said lower surface of said pallet platform so as to define therebetween, along said transversely extending sides of said pallet platform, at least one space for accommodating a pallet handling device;

a load disposed upon an upper surface of said pallet platform;

a heat-shrinkable film covering said load such that dependent lower end portions of said film extend below said longitudinal supports along both of said longitudinally extending sides of said pallet platform and along both of said transversely extending sides of said pallet platform;

means for heat shrinking lower end portions of said film disposed along said longitudinally extending sides of said pallet platform such that said heat-shrunk portions of said film are disposed beneath said longitudinally extending sides of said longitudinal supports; and means for conforming lower end portions of said film disposed along said transversely extending sides of said pallet platform to said transversely extending sides of said lower surface of said pallet platform by raising said lower end portions of said film disposed along both of said transversely extending sides of said pallet platform across the entire width of said at least one space defined along both of said transversely extending sides of said pallet platform and between said at least two longitudinal supports disposed adjacent to said two longitudinally extending sides of said pallet platform such that said raised lower end portions of said film are disposed at a level which is substantially coincident with said lower surface of said pallet platform so as to provide free entry, into said at least one space defined along each one of said transversely extending sides of said pallet platform, of a pallet handling drive from a position external of said palletized load without any interference with said heat-shrinkable film disposed along said transversely extending sides of said pallet platform.

21. The system as set forth in claim 20, wherein:

said heat shrinking means comprises means for blowing hot air toward said palletized load.

22. The system as set forth in claim 20, wherein:

said heat shrinking means comprises a frame member for operatively acting upon peripheral regions of said palletized load.

23. The system as set forth in claim 22, wherein:

said frame member is vertically movable between a first lowered position at which said frame member can heat-shrink said lower end portions of said film, and a second elevated position at which said frame member can heat-shrink upper portions of said film covering said palletized load and disposed along longitudinally extending sides of said palletized load as well as along transversely extending sides of said palletized load.

24. The system as set forth in claim 20, wherein:

said means for conforming said lower end portions of said film disposed along said transversely extending sides of said pallet platform comprises means for raising said lower end portions of said film disposed along said transversely extending sides of said pallet platform until said lower end portions of said film disposed along said transversely extending sides of said pallet platform form heat-sealed beads within the vicinity of said transversely extending sides of said lower surface of said pallet platform.

25. The system as set forth in claim 24, wherein:

said conforming means comprises vertically movable pusher members for engaging lower edge portions of said lower end portions of said film.

26. The system as set forth in claim 20, further comprising:

a third longitudinal support interposed between said at least two longitudinal supports upon said pallet; and means for disposing said lower end portions of said film disposed along said transversely extending sides of said pallet platform away from said pallet so as to prevent adherence of said lower end portions of said film disposed along said transversely extending sides of said pallet platform to said third longitudinal support of said pallet platform while said lower end portions of said film disposed along said transversely extending sides of said pallet platform are being raised and conformed to said transversely extending sides of said lower surface of said pallet platform.

27. The system as set forth in claim 20, further comprising:

means for conforming side edge portions of said lower end portions of said film disposed along said transversely extending sides of said pallet platform to side edge portions, of said at least two longitudinal supports, disposed interiorly of said pallet and facing said at least one space defined between said at least two longitudinal supports.

28. The system as set forth in claim 23, further comprising:

means for fixedly holding said conformed portions of said film in contact with said transversely extending sides of said lower surface of said pallet platform while said frame member heat-shrinks said upper portions of said film covering said palletized load and disposed along said longitudinally and transversely extending sides of said palletized load.

* * * * *